US011469542B2

(12) United States Patent
Bailey

(10) Patent No.: US 11,469,542 B2
(45) Date of Patent: Oct. 11, 2022

(54) JACK CAPS

(71) Applicant: Andy Bailey, Francis, UT (US)

(72) Inventor: Andy Bailey, Francis, UT (US)

( * ) Notice: Subject to any disclaimer, the term of this patent is extended or adjusted under 35 U.S.C. 154(b) by 0 days.

(21) Appl. No.: 16/388,861

(22) Filed: Apr. 18, 2019

(65) Prior Publication Data

US 2019/0379155 A1 Dec. 12, 2019

Related U.S. Application Data

(63) Continuation-in-part of application No. 15/345,435, filed on Nov. 7, 2016, now abandoned.

(51) Int. Cl.
*H01R 13/46* (2006.01)
*H01R 13/52* (2006.01)
*H01R 24/58* (2011.01)

(52) U.S. Cl.
CPC ..... *H01R 13/5213* (2013.01); *H01R 24/58* (2013.01)

(58) Field of Classification Search
CPC ..... H01R 13/5213; H01R 24/58; H01R 4/22; H01R 4/70; H01R 13/44; H01R 13/443
USPC ..... 439/892, 528, 693, 718, 134–136, 148, 439/149; 174/182, 188, 74 a
See application file for complete search history.

(56) References Cited

U.S. PATENT DOCUMENTS 2,560,683 A * 7/1951 Buchanan ..... H01R 4/22 174/87
4,938,705 A * 7/1990 Kanno ..... H01R 13/53 439/125
5,533,912 A * 7/1996 Fillinger ..... H01R 13/5205 439/521
5,573,412 A * 11/1996 Anthony ..... H01R 13/5213 220/242
6,083,016 A * 7/2000 Waynick, Sr. ..... H01R 13/60 439/135
6,227,717 B1 * 5/2001 Ott ..... G02B 6/3849 385/134
6,402,533 B1 * 6/2002 Fan Wong ..... F21V 15/00 362/653
7,094,094 B2 * 8/2006 Zahnen ..... H01R 13/518 439/521
7,220,137 B1 * 5/2007 Liu ..... H01R 13/447 220/375
7,262,363 B2 * 8/2007 Fukuda ..... H01R 13/5213 174/84 C
7,354,284 B2 * 4/2008 Aime ..... H01R 13/443 439/148
8,525,026 B1 * 9/2013 Rhea ..... H01R 43/00 174/87
8,864,519 B2 * 10/2014 Wei ..... H01R 13/405 439/578
9,331,401 B2 * 5/2016 Pineda ..... H01R 4/2408
2006/0148336 A1 * 7/2006 Zahnen ..... H01R 13/5213 439/798

(Continued)

*Primary Examiner* — Harshad C Patel
(74) *Attorney, Agent, or Firm* — Wood IP LLC

(57) ABSTRACT

An insert attachment for covering a jack of cable cord, the insert attachment including a housing with a rear and front portion wherein the front portion diameter is greater than the rear portion diameter. The insert attachment may include a protective sleeve. The insert attachment may further include inner and outer coating layers on the surface of the housing with various density or hardness.

9 Claims, 5 Drawing Sheets

(56) References Cited

U.S. PATENT DOCUMENTS

| | | | | |
|---|---|---|---|---|
| 2007/0099456 | A1* | 5/2007 | Chawgo | H01R 24/40 439/135 |
| 2010/0072440 | A1* | 3/2010 | Wright | H02G 1/081 254/134.3 R |
| 2010/0129043 | A1* | 5/2010 | Cooke | G02B 6/3849 385/139 |
| 2010/0173515 | A1* | 7/2010 | Dickenson | H01R 4/22 439/391 |
| 2010/0216324 | A1* | 8/2010 | Lust | H01R 13/5213 439/135 |
| 2010/0240238 | A1* | 9/2010 | Hattori | G02B 6/3849 385/134 |
| 2012/0267270 | A1* | 10/2012 | Iwami | B65D 59/04 206/327 |
| 2013/0247818 | A1* | 9/2013 | Wang | C02F 1/001 210/234 |
| 2014/0202944 | A1* | 7/2014 | Wes | C02F 1/001 210/234 |

* cited by examiner

JACK CAPS

FIELD

The present invention relates to the field of an insert for covering a jack of cable cords. The invention, particularly relates to a cap and covering for one or more cable cord jacks.

BACKGROUND

Makers and user of electric instruments need to maintain the instrument in an optimal playing condition. One area key for protection is the audio jack of a cable cord while it is unplugged and not in use. Thus, it may help maintain an optimal sound for an electric instrument by including a covering for one or more jacks of the cable cords. A suitable covering helps ensure the jack is maintained in a proper working order for long term use and also prevents harmful particles from degrading the quality of the jack and connection. This is important for maintaining the sound quality of the electrical instrument in which the audio output may degrade over time. In short, jacks are ubiquitous as connectors for audio equipment and are continuously open to the surrounding environment. Thus, is it important that the audio jack of an electrical instrument is protected from damage in the form of dust, particles, moisture, and/or other materials that may damage or compromise the quality of the connector while the device is not in use.

Currently, it is common for some users concerned about preserving the instrument and the quality of sound to select an insert for cable cords that includes some covering or capping. Thus, the user may preserve the sound that has been achieved on the particular instrument. Many different styles of patch cable caps and inserts are available in differing lengths and having different shapes for cable cords and jacks. U.S. Pat. No. 7,476,798 B1 to Beller et al. describe battery access cover cap for an electric guitar and other stringed musical instruments that may be mounted on an audio phone jack that delivers the instrument's audio output.

U.S. Patent Application No. US 20050045021 A1 Berger et al. disclose an improved strap button and attachment including a carrying strap that may be securely attached to a musical instrument. The attachment includes a two-piece design including a lug and face cap that also reduces the transfer of musical vibrations from the instrument to the strap button by including rubber O-rings between the bottom surface of the lug and instrument body.

U.S. Pat. No. 4,798,119 A to Leifheit discloses a positioner to secure a string of a fretted stringed instrument at designated positions. Further, the positioner described includes an insert fixedly held in the fret board of the neck of the guitar.

This prior art in the field of endeavor and other similar solutions may strive to provide an insert for the cable cords of musical instruments for efficient covering or capping of the end area. However, the prior art includes a number of limitations and shortcomings such as, but not limited to, an inability to provide a frequent removing mechanism from the device by the user which interferes with easy operation. The present inventive aspects include a number of improvements including an easy use and removal mechanism for the insert protectors. The inventive aspects also include a cap for a plurality of jacks for electric instruments. Thus, the present invention includes various improvements and solutions to protect the jacks of electric instruments.

Accordingly, there remains a need in the prior art to have an improved cap and cover for efficient insertion and protection for at least one of jack of an electric instrument. The present inventive aspects include a number of improvements including an easy insertion for the protectors as well as an easy removal mechanism. The system enables the user to transport and store the instrument without having a cumbersome attachment. The inventive aspects also include a cap for a plurality of jacks. Thus, the present invention includes various improvements and solutions to protect the jacks of electric instruments.

SUMMARY

In the view of the forgoing disadvantages inherent in the known types of caps or covers for the jacks of musical instruments now present in the prior art, the present invention provides an improved inserting attachment for musical instruments. As such, the general purpose of the present invention, which will be described subsequently in greater detail, is to provide a new and improved cap and covering having an insert assembly for musical instruments.

The inventive aspect described in the specification can be embodied in a device for a cap for covering the jack of cable cords comprising a housing having a rear and front portion wherein the front portion diameter is greater than the rear portion diameter.

The further inventive aspects can be embodied in an insert attachment for protecting the jack portion of the musical instrument cable which may include a protective sleeve on the jack of the cable cord.

The other inventive aspects can be embodied in a means of housing for enclosing the jack surface to protect it from the harmful conditions, such as from dust, particles, corrosion and other hazardous materials, while the device or instrument is not in use.

Yet other inventive aspects can be embodied in providing a cap for covering the jack of a cable cord having an inner and outer coating layer on a surface of the housing.

The inventive aspect described in the specification can be embodied in a system for providing a cap that is designed to be placed over a plurality of jacks to keep them from damaging one another and, further, being damaged by harmful dust, particles, and moisture.

The further inventive aspects can be embodied in an insert attachment cap or covering for at least one jack that may be made from a material selected from a rubber based compound or a type of plastic.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof.

DETAILED DESCRIPTION

In the following detailed description, reference is made to the accompanying drawings which form a part hereof, and in which is shown by way of illustration specific embodiments in which the invention maybe practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting defense, and the scope of the present invention is defined by the appended claims and their equivalents.

Figure 1:
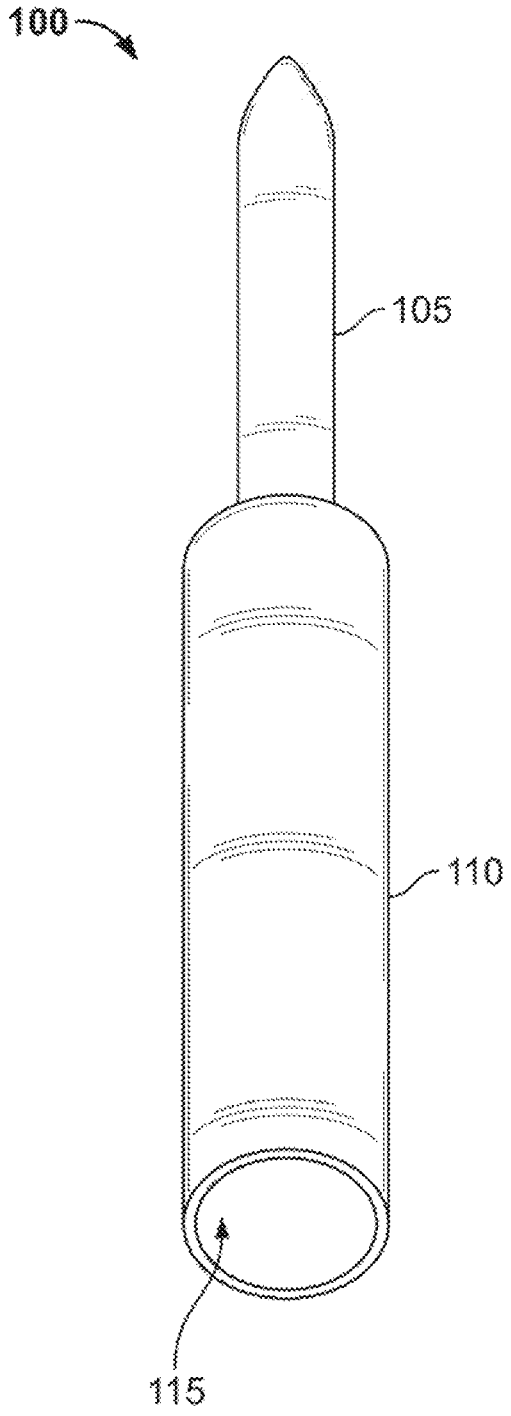
FIG. 1 shows an insert attachment cap for covering a jack of a cable cord in accordance with an example embodiment.

FIG. 1 shows an insert attachment or cap 100 for covering at least one jack of an audio cable. In one embodiment, at least one jack covering comprises a housing having a rear portion 105 and a front portion 110. In one embodiment, the at least one jack insert attachment includes an open space between the front portion 110 and the rear portion 105, such as a passageway. In one embodiment, at least one jack insert attachment includes an opening 115 that is formed in the front portion 110 of the housing for receiving an audio cable having a substantially planar contact terminal for the at least one jack. In one embodiment, the front portion 110 includes a first inner surface defining a first inner hole and the rear portion 105 includes a second inner surface defining a second inner hole. In one embodiment, the first inner hole diameter is greater than the second inner hole.

In one embodiment, the insert attachment 100 is configured to provide an opening 115 which is formed in the front portion 110 of the housing for the at least one jack receiving cable cords having a substantially planar contact terminal. In one embodiment, the front portion 110 and rear portion 105 have a first and second inner surface which defines a first and second inner hole. In this embodiment, the first inner hole diameter may be greater than the second inner hole diameter. In one embodiment, the insert attachment 100 may be configured as a sleeve shape to protect a plurality of jacks of the audio cables. In one embodiment, the plurality of jacks is covered by in individual insert attachment 100. In one embodiment, a strap is configured for holding the plurality of insert attachments or caps together for at least one user to connect the insert attachments easily.

The jack insert may not be limited to one step. In a further example embodiment, the jack inset may have three steps with the first inner hole having greater diameter than that second inner hole and the second inner hole having greater diameter than the third inner hole.

Figure 2:
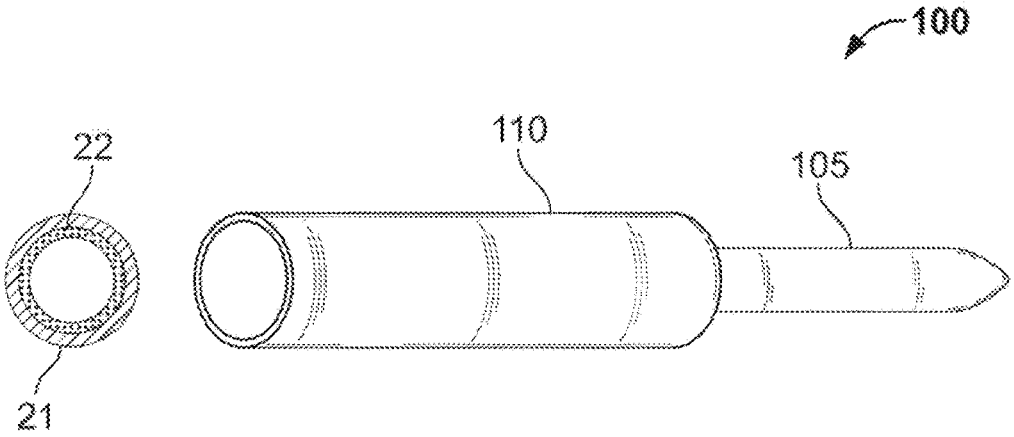
FIG. 2 shows an insert attachment cap illustrating a harder outer plastic coating as well as a softer inner coating in accordance with an example embodiment.
Figure 3A:
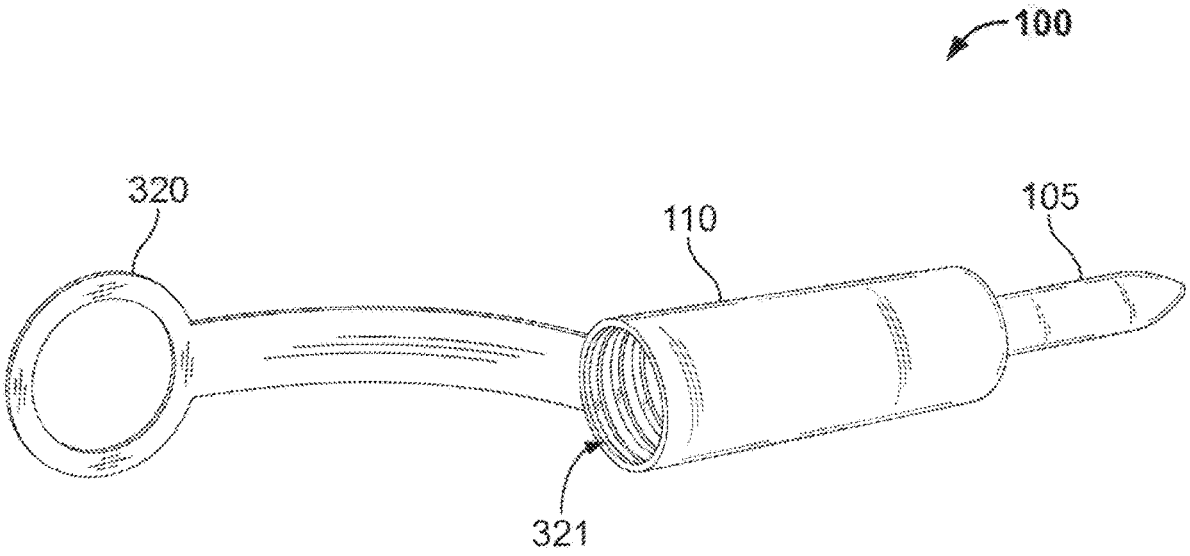
FIGS. 3A and 3B show insert attachment cap for covering a jack of a cable cord with O-ring attachment in accordance with an example embodiment.
Figure 3B:
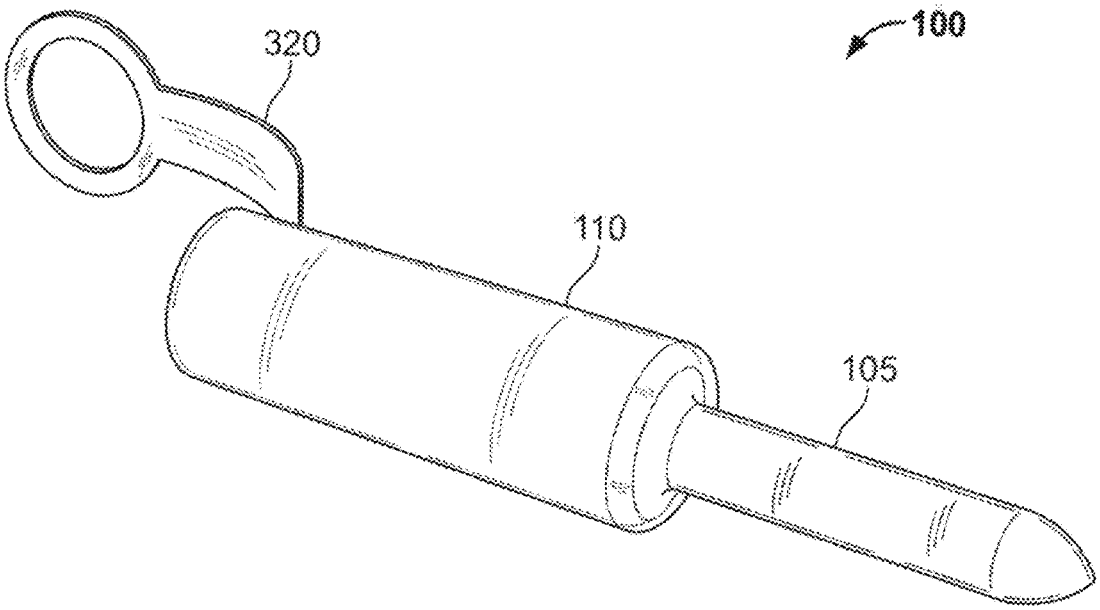
Figure 3C:
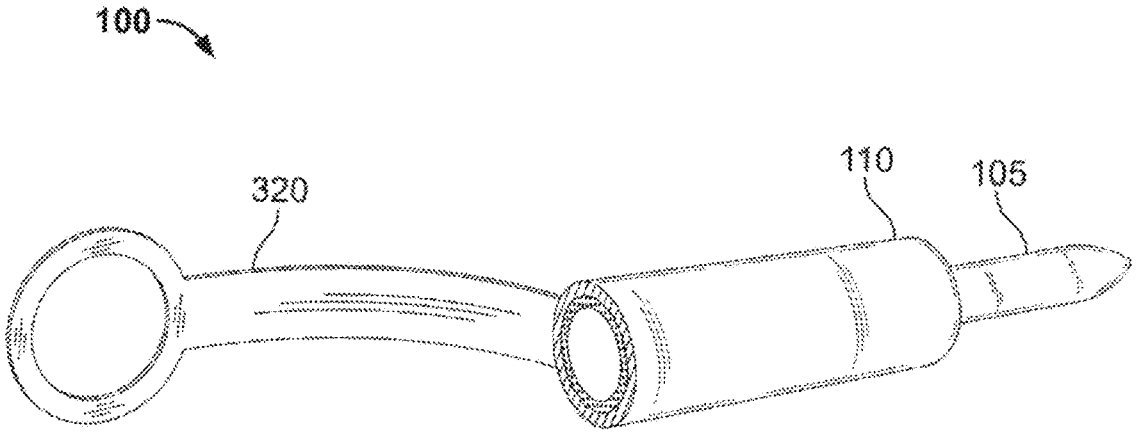
FIGS. 3C and 3D show a different view of the insert attachment cap in accordance with an example embodiment.
Figure 3D:
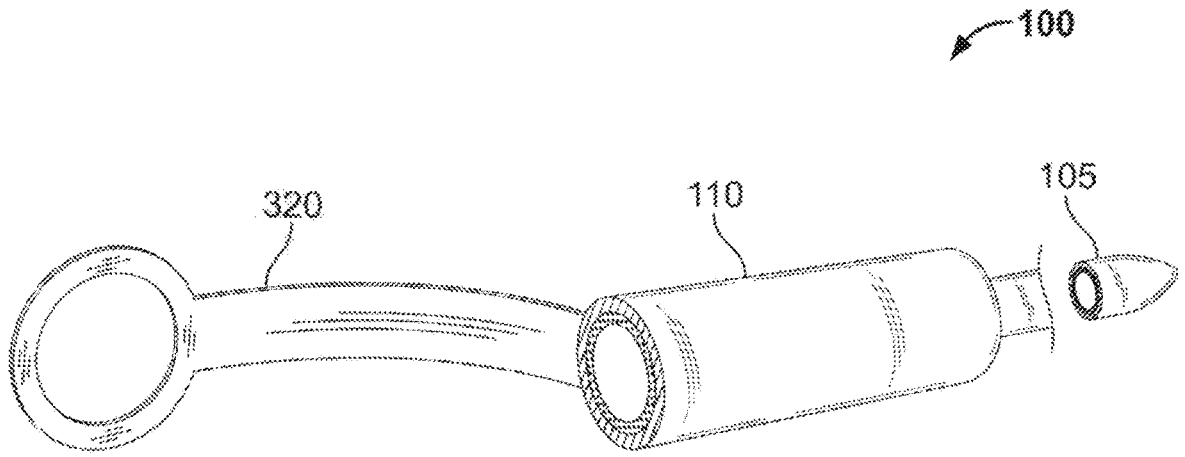
Figure 3E:
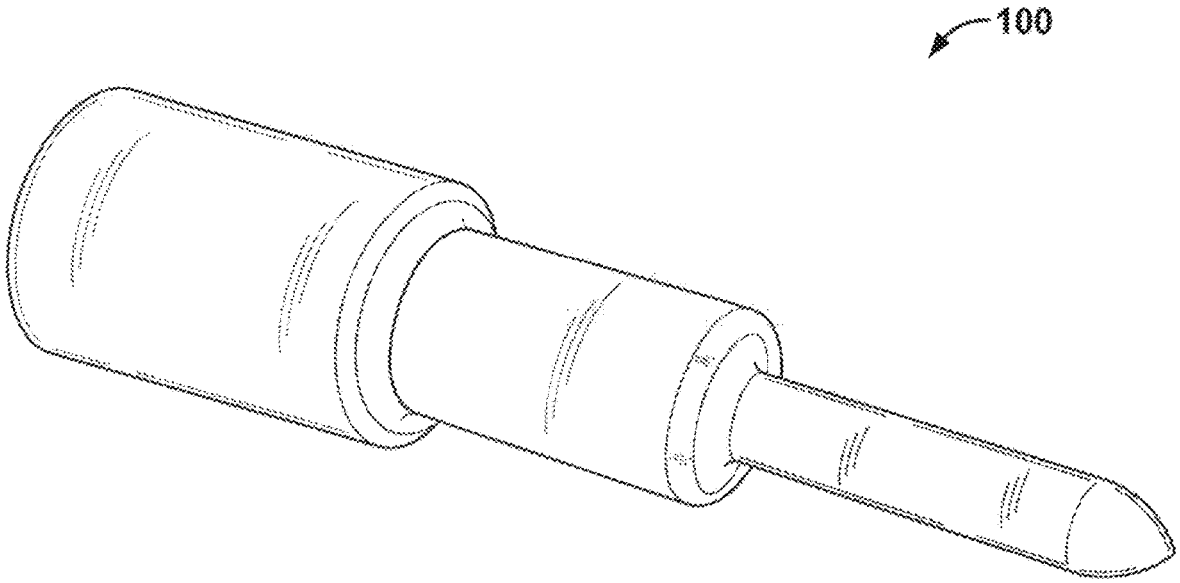
FIG. 3E shows a two step insert attachment cap in accordance with an example embodiment.

FIG. 2 shows a bottom view and a front view of the insert attachment or cap 100 having an outer and inner surface that is covered with an outer and an inner coating respectively. In one embodiment, the outer coating may be selected from a dense and/or hard plastic coating material 21. In one embodiment, this inner coating may be selected from the group of light and softer plastic coated material. In choosing a coating for an inner and outer surface, the material is selected from dual density plastic. Further, the insert could be of appropriate size for any combination of the various types of jacks of the cable cord as per the requirement.

In an example embodiment, the front portion 110 is 1¾ inch long, rear portion 105 is 1¼ inch long and the diameter of the front portion is ½ inch and the diameter of the rear portion is ¼ inch.

In another example embodiment, the inner softer plastic layer 22 includes a plurality of circular rings for providing better tightness with the jacks.

FIG. 3A-3E show caps for covering a jack of a cable cord with O-ring attachment 320. In an example embodiment, the O-ring is configured to tightly secure the area between the jack and the cap to further protect the jack from dust particles, corrosion, hazardous materials or a combination thereof.

Figure 4:
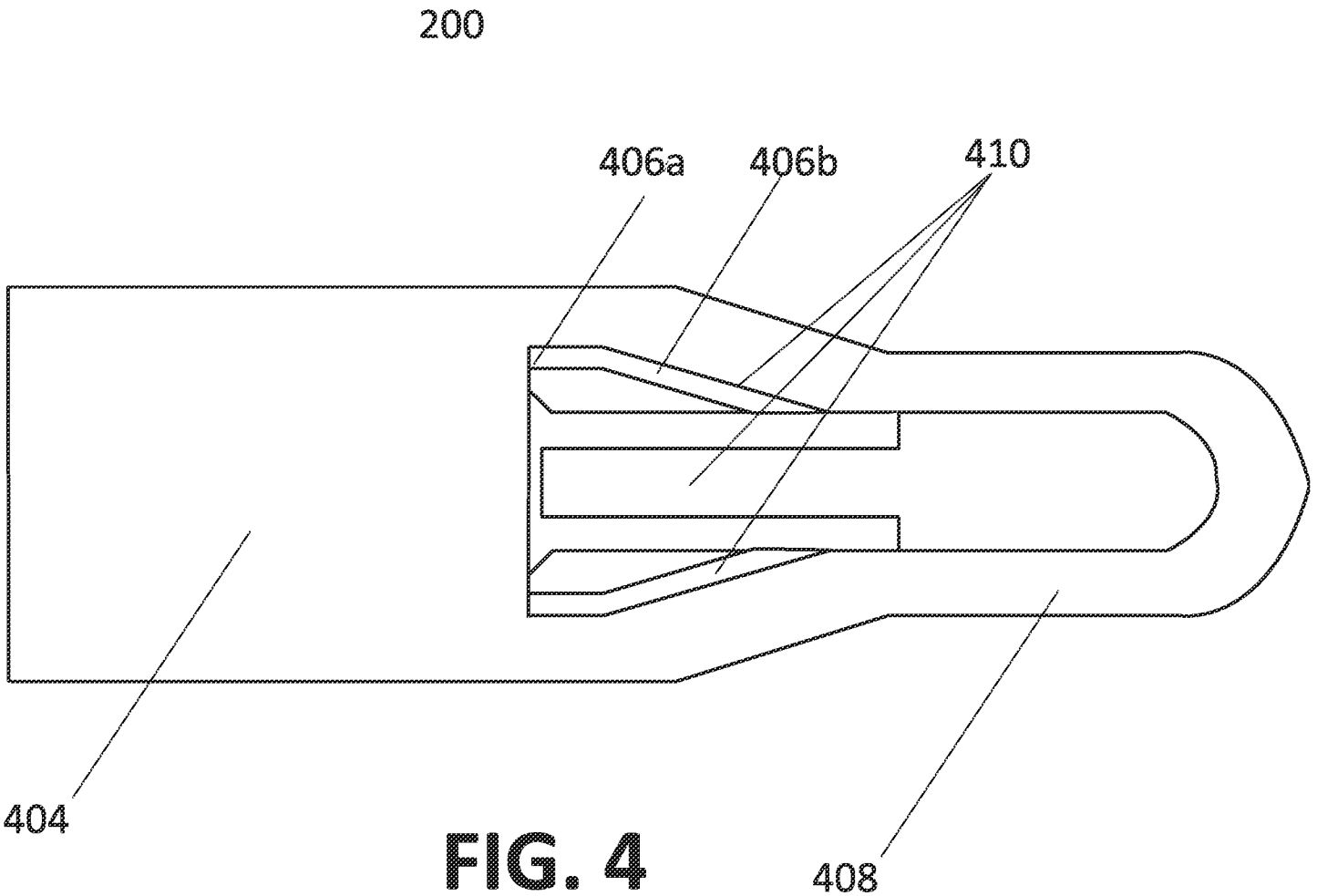
FIG. 4 is an illustration of an insert attachment cap having a hard ribbed outer coating in accordance with another example embodiment.

FIG. 4 is an illustration of a tapered insert attachment cap 200 having a hard-ribbed outer coating in accordance with another example embodiment. The insert attachment 200 includes a base 404, a middle section 406, and a tip section 408. In the cap 200, the middle section 406 may include a non-tapered portion 406*a* and a tapered portion 406*b*. The portion 406*b* is desirably tapered beginning at the non-tapered portion 406*a* to an area near the tip section 408. The middle section 406 includes a plurality of ribs 410 extending longitudinally along the outer surface of the middle section 406 and affixed thereto. The ribs 410 are tapered to match tapering of the tapered portion 406*b*. The tapering, along with the ribs 410, provides the cap 200 with additional strength and rigidity, without making the cap 200 overly large or bulky. In one embodiment, the tapering and ribs provide additional support the base 404 of the 200, reducing in diameter toward the tip 408.

In a further example embodiment, the front portion of the cap may include a ridged ring 321 inside cap for providing further protection of the jack.

It is to be understood that the above description is intended to be illustrative, and not restrictive. For example, the above-discussed embodiments may be used in combination with each other. Many other embodiments will be apparent to those of skill in the art upon reviewing the above description.

The benefits and advantages which may be provided by the present invention have been described above with regard to specific embodiments. These benefits and embodiments, and any elements or limitations that may cause them to occur or to become more pronounced, are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within that scope of the invention.

What we claim is:

1. A cap for covering a jack of a cable cord, the cap comprising:

a hollow housing comprising:

a base section having a first diameter configured for insertion of the jack, a tapered middle section, and a tip section having a second diameter being smaller than the first diameter; and a plurality of ribs extending longitudinally along a length of an outer surface of the tapered middle section and affixed thereto;

wherein the housing includes an inner surface formed of a first material and an outer surface formed of a second material;

wherein the inner surface and the outer surface form a dual density plastic;

wherein the first material is softer than the second material, and the first material includes a plurality of rings configured to provide tightness for the jack; and wherein the base section includes a plurality of steps therein.

2. The cap of claim 1, wherein the tapered middle section further includes at least one non-tapered portion.

3. The cap of claim 2, wherein the tapered middle section further includes a tapered portion, a first non-tapered portion and a second non-tapered portion.

4. The cap of claim 3, wherein the first non-tapered portion is on one end of the tapered portion, and the second non-tapered portion is on an end opposite the first non-tapered portion.

5. The cap of claim 4, wherein a diameter of decreases from the base section to the tip section.

6. The cap of claim 1, wherein the base section includes an 0-ring attachment.

7. The cap of claim 6, wherein the base portion section, the middle section and the tip section are integrally formed together.

8. The cap of claim 7, wherein a contour of the inner surface is substantially identical to a contour of the outer surface.

9. The cap of claim 8, wherein the material of the outer surface is more dense than the material of the inner surface.

* * * * *